US009168414B2

(12) United States Patent
Liu et al.

(10) Patent No.: US 9,168,414 B2
(45) Date of Patent: Oct. 27, 2015

(54) FOLDABLE TREADMILL

(71) Applicant: Dyaco International Inc., Taipei (TW)

(72) Inventors: Shih Wei Liu, Taipei (TW); Wei Chieh Huang, Taipei (TW); Hsuan Fu Huang, Taipei (TW)

(73) Assignee: Dyaco International Inc., Taipei (TW)

( * ) Notice: Subject to any disclaimer, the term of this patent is extended or adjusted under 35 U.S.C. 154(b) by 73 days.

(21) Appl. No.: 14/064,519

(22) Filed: Oct. 28, 2013

(65) Prior Publication Data

US 2015/0051051 A1 Feb. 19, 2015

(30) Foreign Application Priority Data

Aug. 14, 2013 (TW) ..... 102129208 A

(51) Int. Cl.
*A63B 22/02* (2006.01)

(52) U.S. Cl.
CPC ..... *A63B 22/02* (2013.01); *A63B 2210/50* (2013.01)

(58) Field of Classification Search
CPC ..... A63B 22/02–2022/0292; A63B 22/023; A63B 2210/50; A63B 2210/56
USPC ..... 482/54
See application file for complete search history.

(56) References Cited

U.S. PATENT DOCUMENTS

| | | | | |
|---|---|---|---|---|
| 2002/0103057 | A1* | 8/2002 | Watterson et al. | 482/54 |
| 2005/0192162 | A1* | 9/2005 | Pan et al. | 482/54 |
| 2006/0122038 | A1 | 6/2006 | Lin | |
| 2008/0248935 | A1* | 10/2008 | Solow et al. | 482/142 |
| 2012/0283070 | A1 | 11/2012 | Lai et al. | |
| 2013/0237381 | A1* | 9/2013 | Chen et al. | 482/54 |

FOREIGN PATENT DOCUMENTS

| | | | |
|---|---|---|---|
| CN | 201399197 | Y | 2/2010 |
| CN | 202554815 | U | 11/2012 |
| DE | 202013104911 | U1 | 11/2013 |
| TW | M432443 | | 7/2012 |

OTHER PUBLICATIONS

Office Action Dated Nov. 10, 2014 in corresponding Taiwan Patent Application No. 102129208.
International Search Report dated May 21, 2014 in related PCT Application CN2013/001267. International Filing Date Oct. 18, 2013.

* cited by examiner

*Primary Examiner* — Loan H Thanh
*Assistant Examiner* — Jennifer M Deichl
(74) *Attorney, Agent, or Firm* — Donald E. Stout; Stout, Uxa & Buyan, LLP

(57) ABSTRACT

A foldable treadmill includes a base for running or walking, a frame set pivotally connected with the base, and a folding mechanism for folding the frame set. The folding mechanism has a control assembly comprising a knob and a first bolt controlled by the knob. When a part of the first bolt is arranged inside the frame set, the frame set cannot be folded, and when the first bolt is moved out of the frame set, the frame set can be folded to a storage configuration.

9 Claims, 10 Drawing Sheets

FOLDABLE TREADMILL

CROSS-REFERENCE TO RELATED APPLICATIONS

The entire contents of Taiwan Patent Application No. 102129208, filed on Aug. 14, 2013, from which this application claims priority, are incorporated herein by reference.

BACKGROUND OF THE INVENTION

1. Field of the Invention

The present invention relates to training machines, and more particularly relates to foldable treadmills.

2. Description of Related Art

Nowadays, people tend to lack adequate exercise due, for example, to busy lifestyles. To the extent running has become popular as a simple and effective means for squeezing physical activity into a tight schedule, it is not always practicable. When the weather is bad or during particular times such as at night, running on a treadmill can be more convenient as compared to being outside. A conventional treadmill, however, may suffer from being too large and thus inconvenient for regular usage which may require frequent commissioning of the device in and out of storage.

Prior treadmills, such as disclosed in Taiwan Patents I303571 and M339319, have sought to advance usability by providing foldability for enabling storage of the treadmills. Yet, the folding mechanisms of the resulting assemblies still have some deficiencies in need of improvement.

SUMMARY OF THE INVENTION

In one general aspect, the present invention relates to foldable treadmills featuring compact folded sizes and easy, fast folding manners of use.

In an embodiment of the present invention, a foldable treadmill is provided with a base on which a user walks or runs in place, a frame set pivotally connected with the base, and a folding mechanism having a control assembly. The control assembly is provided with at least a first bolt and at least a knob used to control the first bolt. When a portion of the first bolt is within the frame set, the frame set cannot be rotated, and when the knob removes the first bolt out of the frame set, the frame set can be rotated and folded to a storage configuration.

In another embodiment of the present invention, a foldable treadmill is formed with a base on which a user can walk or run in place, a frame set pivotally connected with the base and having a first post and a second post, and a folding mechanism comprising a first control assembly and a second control assembly. The first control assembly comprises a first bolt and a first knob, and the second control assembly comprises a second bolt and a second knob. The first knob is used to control the first bolt, such that when a portion of the first bolt is within the first post, the first post cannot be rotated. The second knob used to control the second bolt, so that when a portion of the second bolt is within the second post, the second post cannot be rotated. Therefore, when the first knob removes the first bolt out of the first post and the second knob removes the second bolt out of the second post, the frame set can be rotated and folded to a storage configuration.

BRIEF DESCRIPTION OF THE DRAWINGS

FIGS. 8-11 show the foldable treadmill folded to a storage configuration, wherein FIG. 8 is a partially enlarged view, FIG. 9 is a partially enlarged view taken from another view angle, FIG. 10 is a perspective view, and FIG. 11 is a cross-sectional type view.

FIGS. 12-16 show a foldable treadmill according to another embodiment of the present invention, in which FIG. 12 is a perspective view showing the foldable treadmill in an operable configuration, FIGS. 13 and 14 are a partially enlarged view and a cross-sectional type view showing the treadmill in the operable configuration, FIG. 15 is a partially enlarged view showing a plug being moved to a second end of a trench, and FIG. 16 is a perspective view showing the treadmill folded to a storage configuration.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

FIGS. 1-11 show a foldable treadmill according to a preferred embodiment of the present invention, in which the foldable treadmill comprises a base 2, a frame set 4, and a folding mechanism 6.

Figure 1:
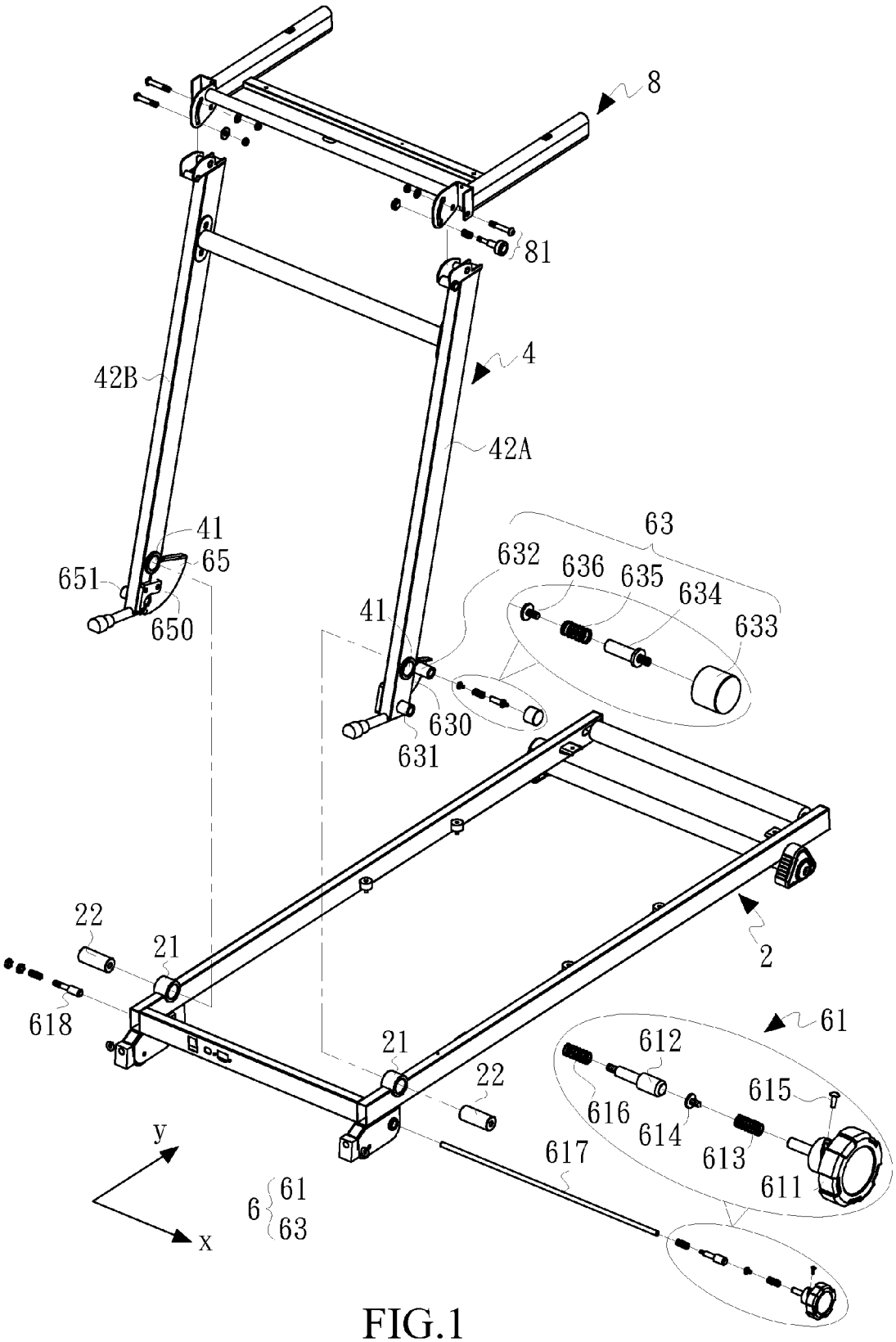
FIG. 1 is an exploded view showing the foldable treadmill according to a preferred embodiment of the present invention.
Figure 7:
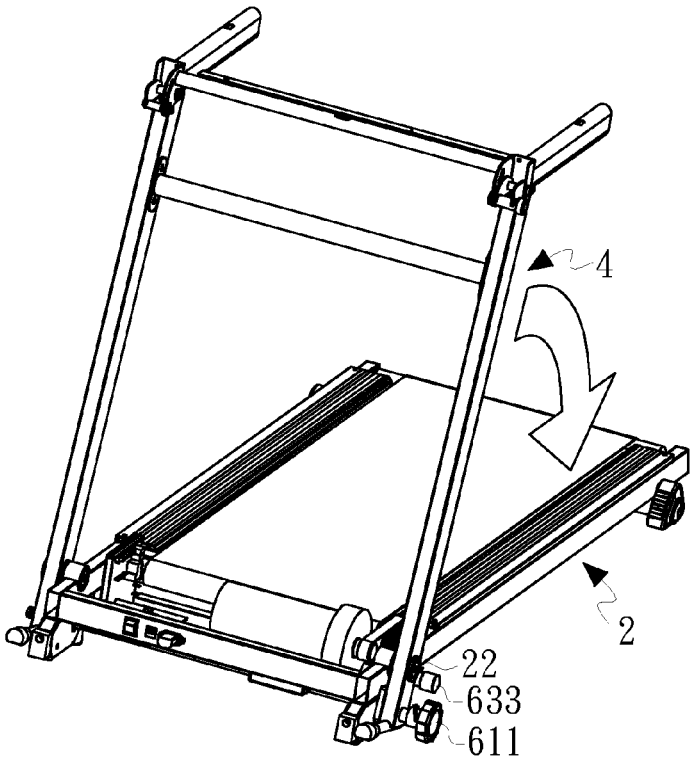
Figure 10:
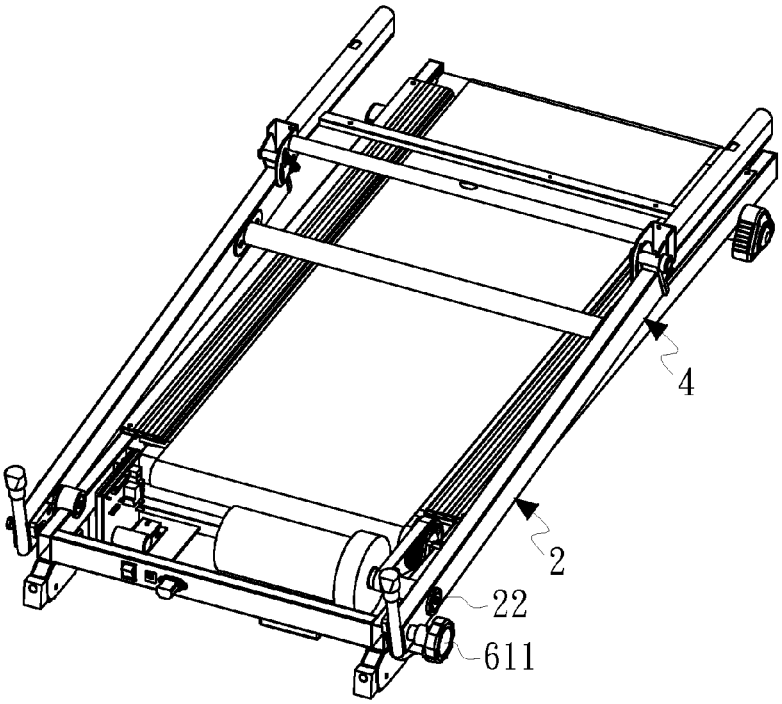

The frame set 4 pivotally connects with the base 2. For example, the frame set 4 may comprise one or more bores 41, and the base 2 may comprise a corresponding one or more bores 21 and shaft(s) 22. The shaft 22 passes through the bore 41 of the frame set 4 and the bore 21 of the base 2, such that the frame set 4 can rotate around the shaft 22. FIG. 1 and FIG. 7 show the frame set 4 in an operable configuration, in which an angel extends between the frame set 4 and the base 2. On the other hand, FIG. 10 shows the frame set 4 rotated to a storage configuration, so that the frame set 4 nearly overlaps with the base 2.

In this embodiment, the frame set 4 is arranged outside of the base 2. In another embodiment, the frame set 4 may be arranged inside of the base 2. Modification, alternation, and equivalent changes may be made to the above configuration. For instance, the pivotal connecting point(s) between the frame set 4 and the base 2 could be at other locations, directly or indirectly. For example, the frame set 4 may pivotally connect with a block or a mechanism (not shown) connected with the base 2, and the block or the mechanism may be arranged above the base 2 or at a front end of the base 2.

Turning again to FIG. 1, the folding mechanism 6 mainly includes a control assembly 61, which comprises a knob 611 and a first bolt 612. The knob 611 is used to control the first bolt 612. When a part of the first bolt 612 is within the frame set 4, the frame set 4 cannot rotate around the shaft 22. When the first bolt 612 is moved out of the frame set 4, the frame set 4 can rotate around the shaft 22 and thus can be folded.

Additionally, in this embodiment the folding mechanism 6 may comprise a stop assembly 63 fixed and linked with the frame set 4. When the frame set 4 is rotated to a storage configuration, a part of the first bolt 612 is placed in the stop assembly 63 so as to prevent rotation of the frame set 4. Details on the above-mentioned mechanisms and associated procedures are provided as follows.

Figure 2:
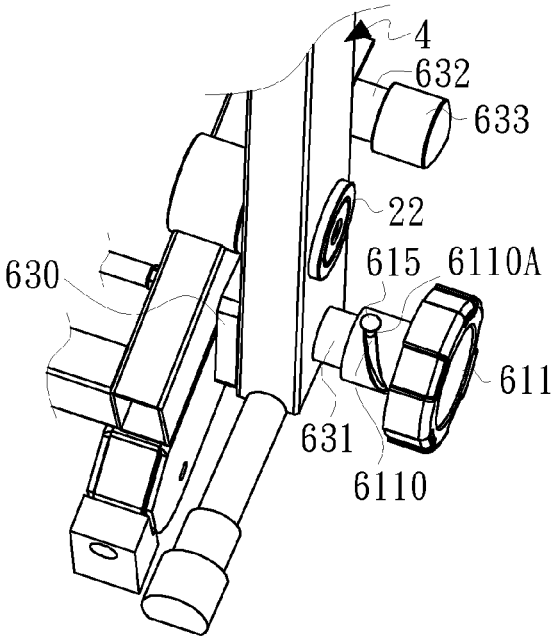
FIGS. 2-4 are a partially enlarged view, a partially enlarged view taken from another view angle, and a cross-sectional type view, respectively, showing the foldable treadmill in an operable configuration.
Figure 3:
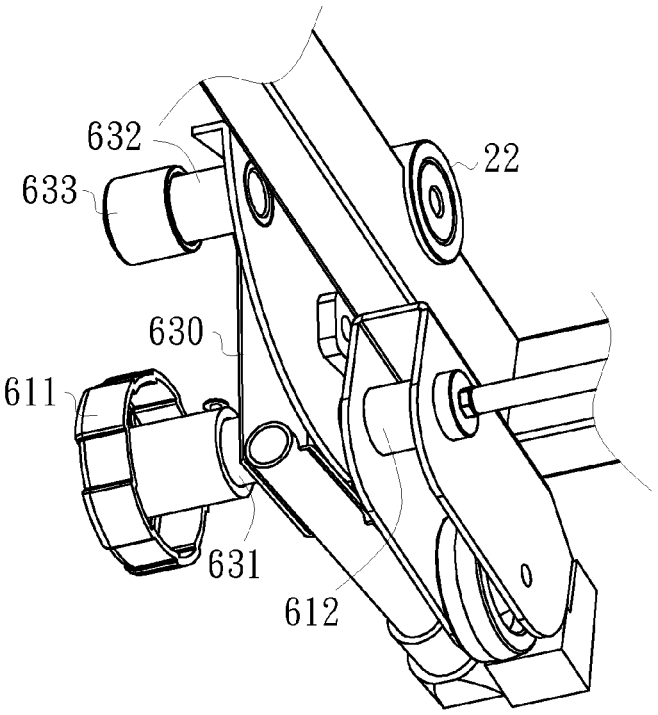
Figure 4:
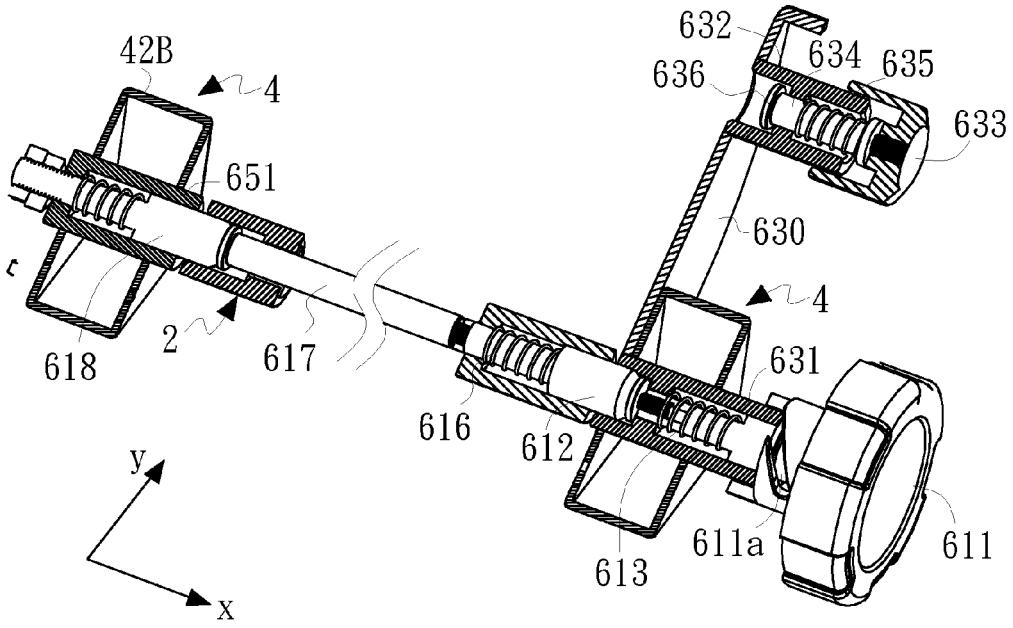

FIGS. 2-4 are a partially enlarged view, a partially enlarged view taken from another view angle, and a cross-sectional type view, respectively, showing the foldable treadmill in an operable configuration.

Referring to FIGS. 1-4, the control assembly 61 may comprise the knob 611, the first bolt 612, a first spring 613, a disk 614, a plug 615, and a second spring 616. The stop assembly 63 may comprise a first hollow cylinder 631, a second hollow cylinder 632, a push button 633, a column assembly 634, a third spring 635, and a discus 636.

The first hollow cylinder 631 and the second hollow cylinder 632 may be arranged on the sheet 630. The first hollow cylinder 631 may pass through the frame set 4 and fix with the frame set 4. In another embodiment, the first hollow cylinder 631 and the second hollow cylinder 632 may be treated as components of the frame set 4, in which case the first hollow cylinder 631 fixes with a corresponding hole of the frame set 4 and the sheet 630 fixes with first hollow cylinder 631 or the frame set 4. The fixing or state of being fixed may comprise, but is not limited to, welding, screwing, tight fitting, and/or the like. The first bolt 613 has two ends in which one end is able to resist the disk 614 and the other end is able to pass through the second spring 616. One end of the knob 611, the first spring 613, the disk 614, and one end of the first bolt 612 are arranged inside the first hollow column 631. The first spring 613 can provide a force in the direction of x to push the knob 611 in the same direction, and the second spring 616 can provide another force in the direction of x to push the first bolt 612 in the x direction. In addition, with reference to FIG. 2, the knob 611 may comprise a trench 6110, with the plug 615 being arranged in the trench 6110 and movable within the trench 6110. As shown in the same figure, when the treadmill is in the operable configuration, the plug 615 is at a first end 6110A of the trench 615.

Figure 5:
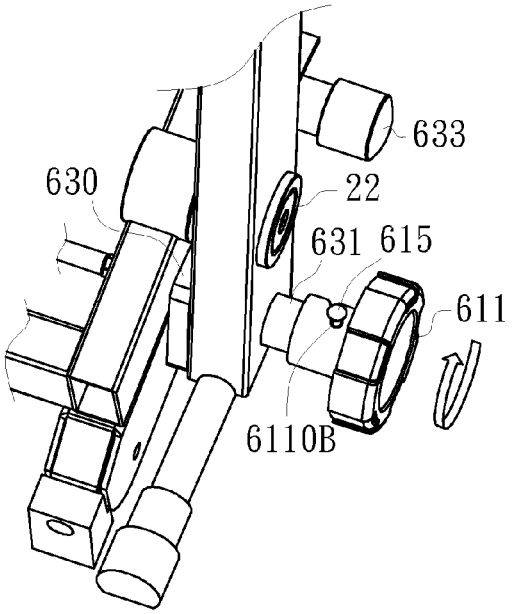
FIGS. 5-7 show the folding procedure of the foldable treadmill according to the preferred embodiment of the present invention.
Figure 6:
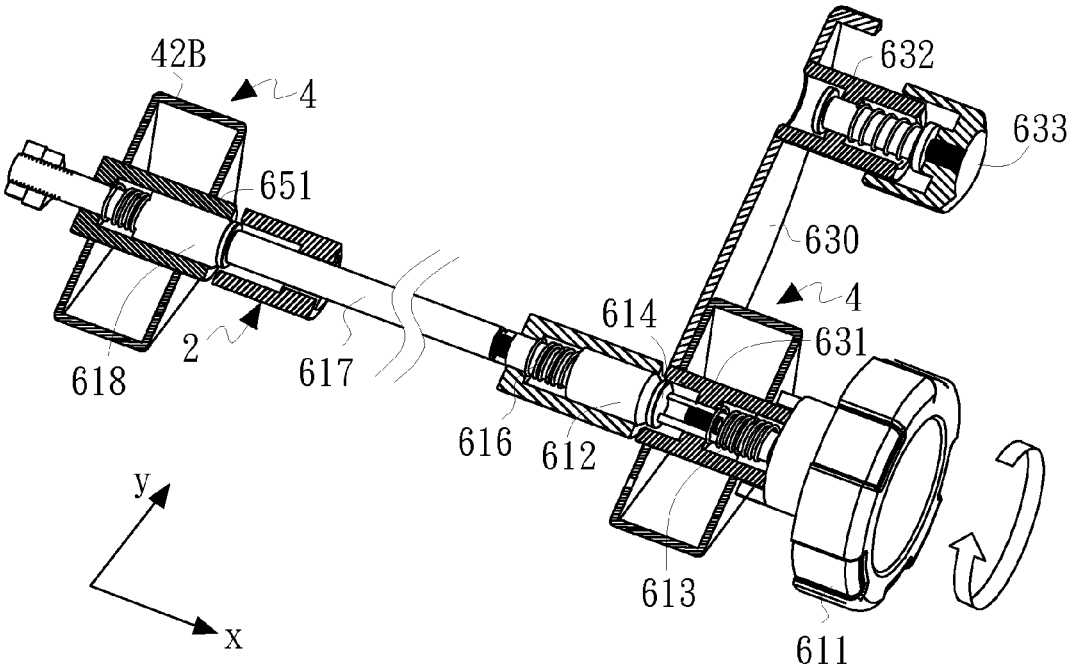

Referring to FIG. 5, when the user wishes to fold the treadmill, he or she may rotate the knob 611 so as to move the plug 6110 to a second end 6110B of the trench 6110. At this moment, the relationship between the control assembly 61, the stop assembly 63, and the frame set 4 are as shown in the cross-sectional type view of FIG. 6. In FIGS. 6-7, the knob 611 is rotated to push the disk 614 pressing the first bolt 612, so as to move the first bolt 612 completely out of the frame set 4. By doing so, the user can fold the frame set 4 by rotating it around the shaft 22 (see FIGS. 5 and 7) in a direction of the arrow as shown in FIG. 7. When the frame set 4 is rotated, the first spring 613 provides a force to the knob 611, making the knob 611 move back to its original position, and resulting in the plug 615 moving back to the first end 6110A of the trench 6110. In the meantime, the second spring 616 provides a force to the first bolt 612 in the direction of x, while the sheet 630 of the stop assembly 63 blocks the first bolt 612 from bounding out.

Figure 8:
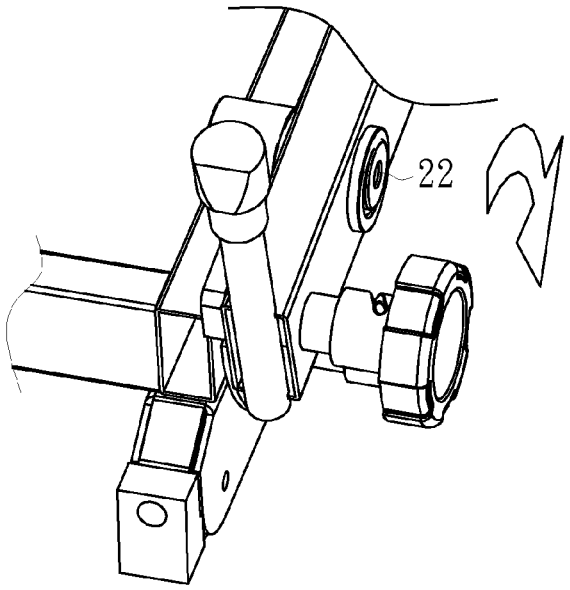
Figure 9:
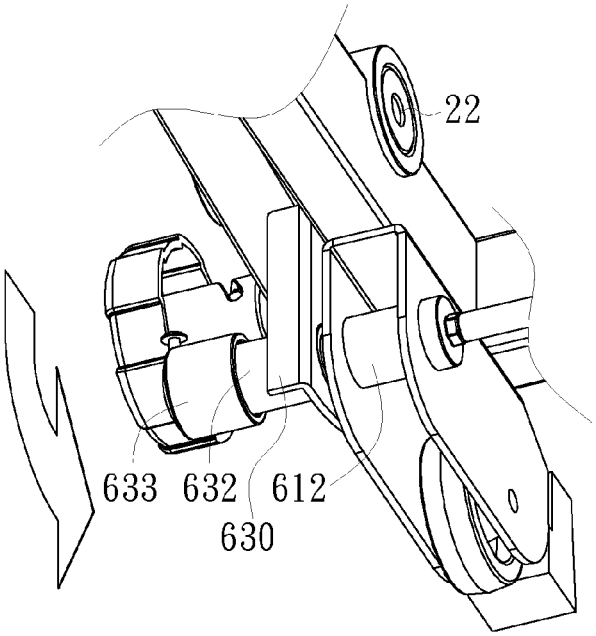
Figure 11:
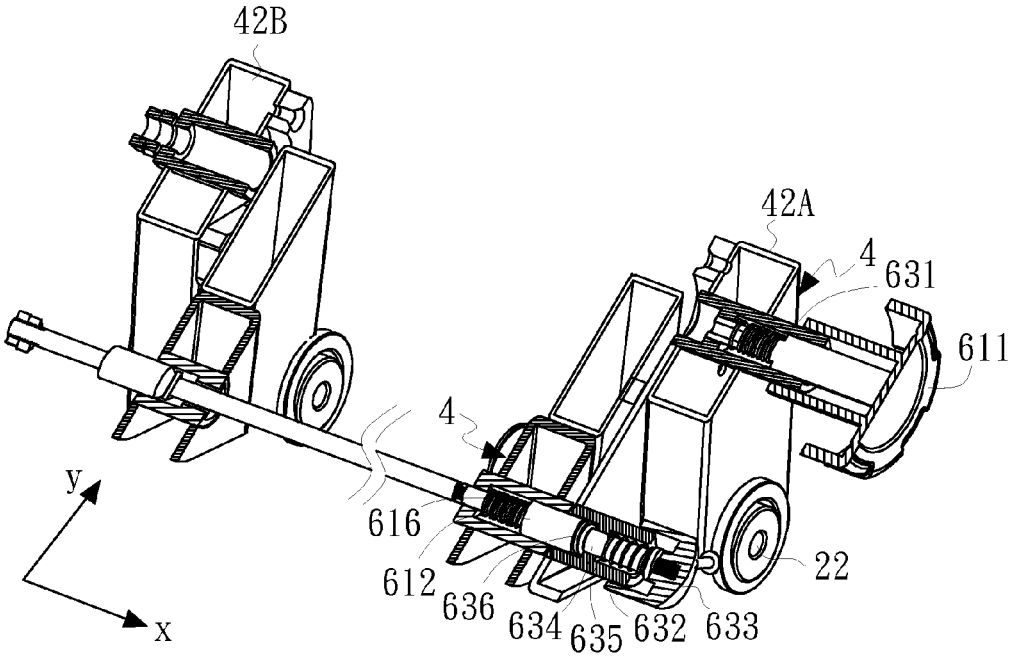

FIGS. 8-11 show the frame set 4 after being folded to a storage configuration overlapping with the base 2. In particular, FIGS. 8 and 9 show partially enlarged views taken from two different view angles, FIG. 10 is perspective view, and FIG. 11 is a cross-sectional type view. When the frame set 4 rotates around the shaft 22, the sheet 630 is also rotated commensurate with its fixed relation with the frame set 4. When the frame set 4 rotates to the storage configuration, the second hollow cylinder 632 points exactly toward the first bolt 612. At this time the first bolt 612 is no longer blocked by the sheet 630, and the first bolt 612 bounds into the second hollow cylinder 632 against the discus 636, via the force or bounce provided by the second spring 616. In this embodiment, the discus 636 is assembled with the column assembly 634, the column assembly 634 is assembled with the push button 633, and the third spring 635 is arranged between the discus 636 and the push button 633, so as to provide a force pushing the push button 633 in the direction of x. Modifications, alternations, and/or equivalents may be made to the above-mentioned mechanisms. Owing to the sheet 630 fixing with the frame set 4, the first bolt 612 entering into the second hollow column 632 will result in the frame set 4 not being able to rotate around the shaft 22, and therefore the frame set 4 becomes fixed with the base 2.

When the user wants to unfold the treadmill and run on the base 2, he or she may push the push button 633 to press the first bolt 612, causing the first bolt 612 to be moved out of the second hollow column 632, such that the frame set 4 can rotate around the shaft 22 again and be unfolded to the operable configuration.

The detail configuration of the frame set 4 should not be limited. In this embodiment, the frame set 4 may comprise two posts, e.g. a first post 42A and a second post 42B, as shown in FIG. 1. The folding mechanism 6 may be arranged at one of the two posts, e.g., at the position near the intersection of the first post 42A and the base 2.

As shown in FIG. 1, the treadmill may further comprise a stop assembly 65 comprising a sheet 650 and a hollow cylinder 651 near the intersection of the second post 42B and the base 2. The hollow cylinder 651 may pass through the second post 42B, and the control assembly 61 may further comprise a linkage bar 617 and a second bolt 618. The first bolt 612 is positioned against the linkage bar 617, and the linkage bar 617 is disposed against the second bolt 618. As shown in FIG. 4, when the frame set 4 is in the operable configuration, a portion of the second bolt 618 is within the base 2, and the other portion of the second bolt 618 is within the hollow cylinder 651. Therefore, the frame set 4 cannot be rotated around the shaft 22.

As shown in FIG. 6, rotation of the knob 611 to cause the plug 615 to move to the second end 6110B of the trench 6110, results in the following: the knob 611 pushes the first bolt 612, and the first bolt 612 pushes the linkage bar 617 out of the base 2 and completely into the hollow cylinder 651. Because the hollow cylinder 651, sheet 650, and the second post 42B are fixed together, the second post 42B can be rotated around the shaft 22 and whereby the frame set can be folded to the storage configuration.

In this embodiment, the treadmill may further comprise an operation panel 8 and a folding mechanism 81. The operation panel 8 connects with the frame set 4 and the folding mechanism 81 is used to fold the operation panel 8. In another embodiment of this invention, the treadmill may not include the operation panel 8 and the folding mechanism 81. In addition, the configuration of the folding mechanism 81 is not limited; it could be same as any other folding mechanisms provided by the assignee of the present application, such as the folding mechanism disclosed in Taiwan patent M432443, the entire contents of which is incorporated herein by reference.

Figure 12:
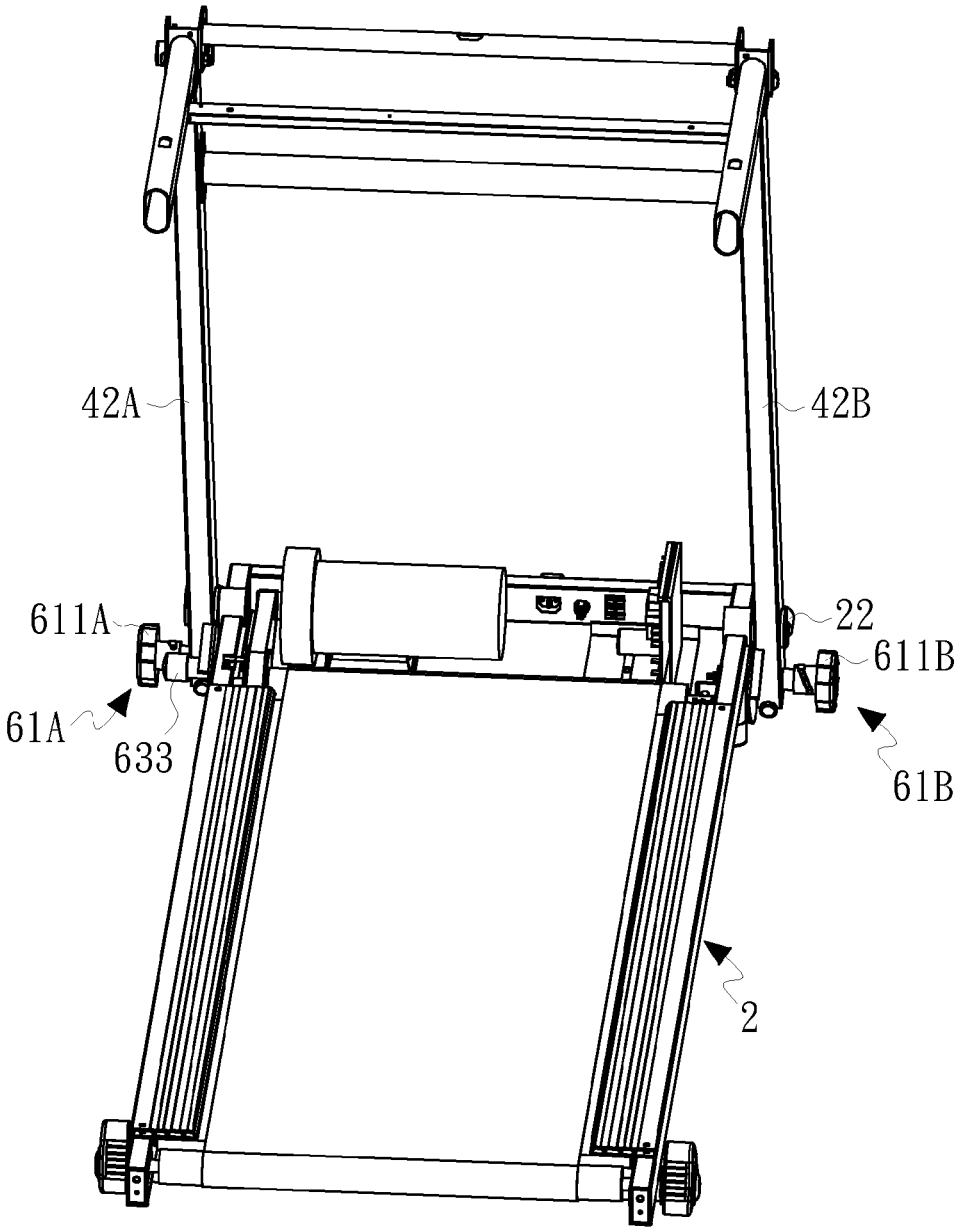
Figure 13:
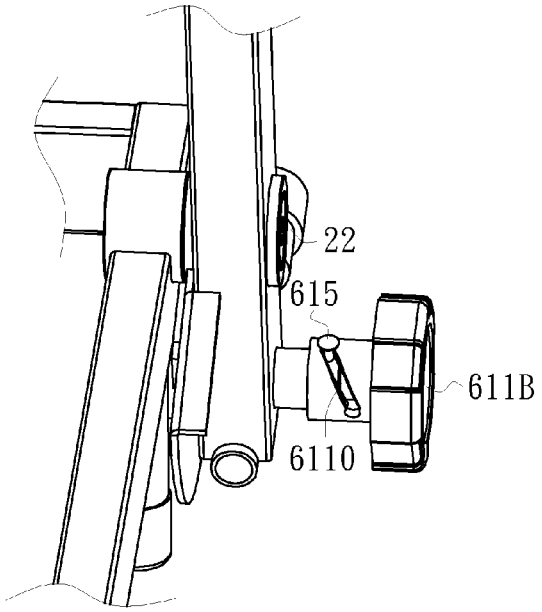
Figure 14:
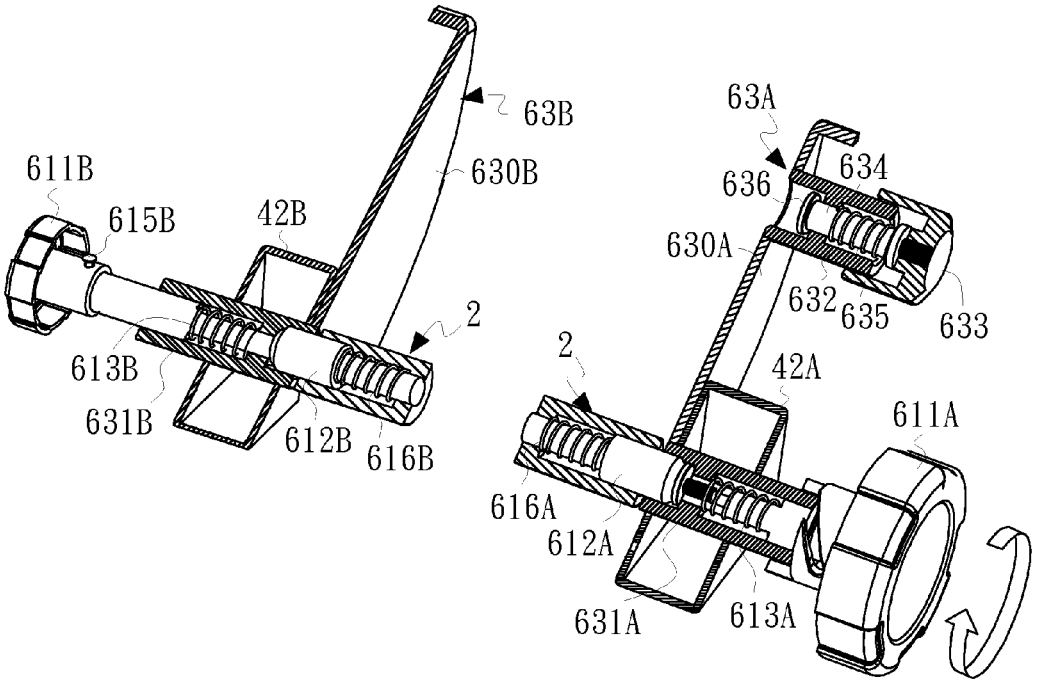
Figure 15:
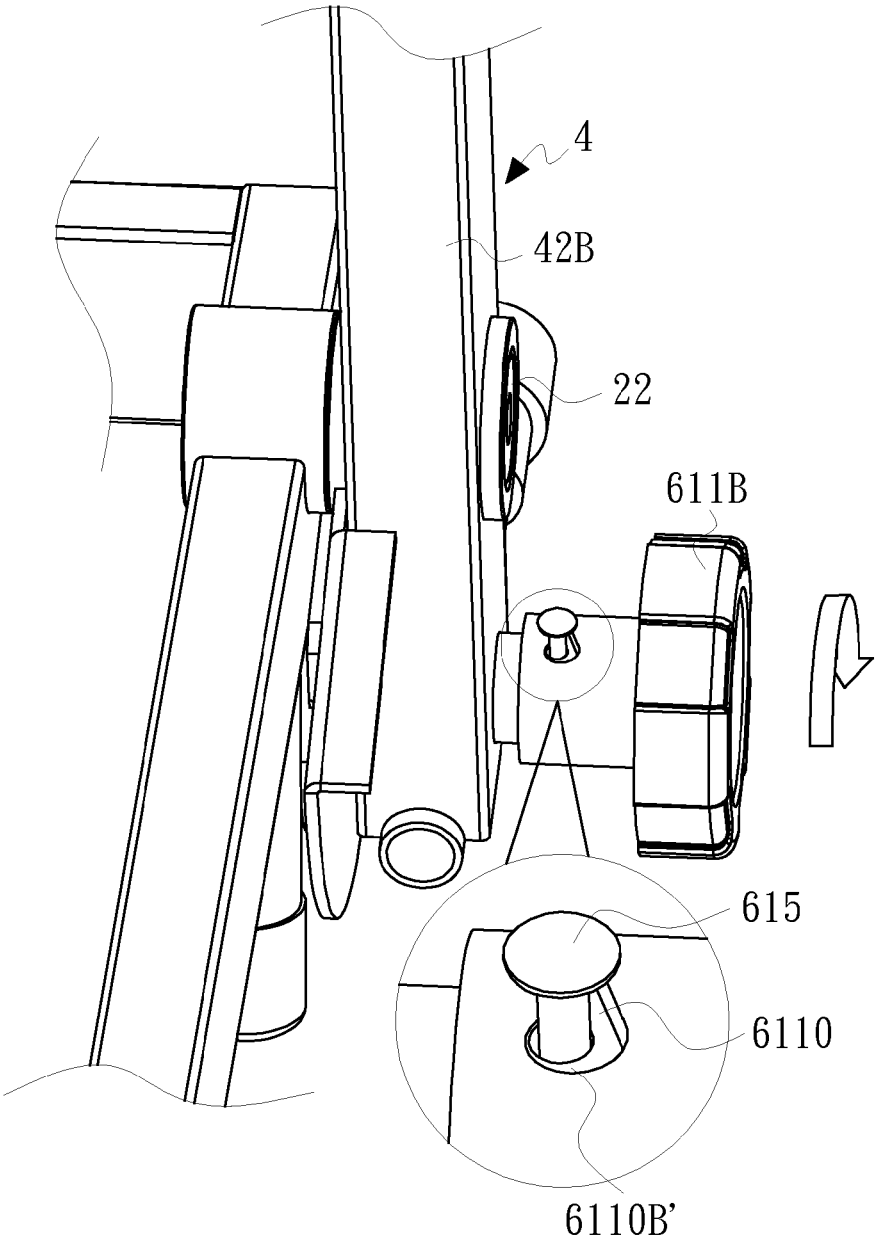
Figure 16:
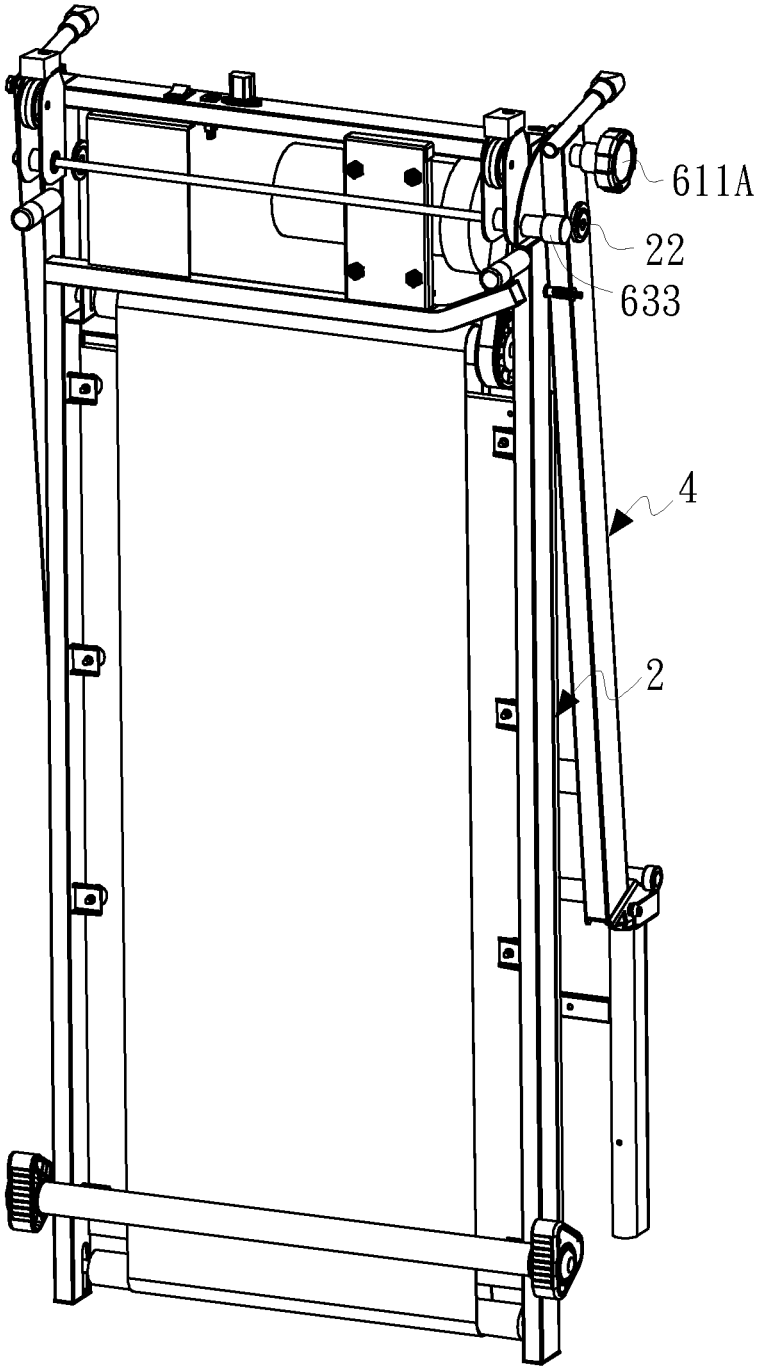

FIGS. 12-16 show a foldable treadmill according to a second embodiment of the present invention, in which FIG. 12 is a perspective view showing the foldable treadmill in an operable configuration, FIGS. 13 and 14 are partially enlarged view and cross-sectional type view showing the treadmill in the operable configuration, FIG. 15 is a partially enlarged view showing a plug being moved to a second end of a trench, and FIG. 16 is a perspective view showing the treadmill folded to a storage configuration.

In this embodiment, the folding mechanism 6 comprises a first control assembly 61A and a second control assembly 61B respectively at a side of the first post 42A and the second post 42B. The first control assembly 61A is essentially the same as the previously mentioned control assembly 61, the difference between them being: the first control assembly 61A is merely used to push the first bolt 612A and does not include a linkage bar 617; and instead of using a linkage bar 617, a second control assembly 61B is used to move the second bolt 612B. The second control assembly 61B has similar components as the first control assembly 61A, and the difference between them is that the second control assembly 61B does not include the second hollow cylinder 632 and the push button 633.

The folding procedure of this embodiment is similar to the previous embodiment; the following merely recites the difference for simplicity. The first control assembly 61A comprises a first knob 611A and a first bolt 612A. The first knob 611A is used to control the first bolt 612A, and when a portion of the first bolt 612A is arranged within the first post 42A, the first post 42A cannot be rotated. The second knob 611B is used to control the second bolt 612B, and when a portion of the second bolt 612B is arranged within the second post 42B, the second post 42B cannot be rotated. Therefore, by employing the first control assembly 61A to remove the first bolt 612A out of the first post 42A, and by employing the second control assembly 61B to remove the second bolt 612B out of the second post 42B, the frame set 4 can be folded to a storage configuration.

As shown in FIG. 15, when the user desires to fold the treadmill, he or she may firstly rotate the second knob 611 B (or the first knob 611A), so as to move the plug 615 to the second end 6110B' of the trench 6110. The second end 6110B' may comprise a bend portion to place the plug 615, so that the knob 611B will not back to the first end 6110A due to a force provide by the first spring 613A. After that, the user rotates the first knob 611A, and then the frame set 4 can be folded to the storage configuration as shown in FIG. 16.

Accordingly, embodiments of this invention provide foldable treadmills featuring a compact folded size and a convenient, fast folding manner.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A foldable treadmill, comprising:

a base on which a user walks or runs in place;

a frame set having a lower portion pivotally connected with a front portion of the base;

an operation panel coupled to an upper portion of the frame set; and a folding mechanism having a control assembly, which comprises:

a first bolt arranged at a side of the frame set, wherein a portion of the first bolt is initially arranged within the base, and a remaining portion of the first bolt is initially arranged within the frame set when the foldable treadmill in an operable configuration; and a knob being contacted with the first bolt and being rotatable to push the remaining portion of the first bolt into the base, so that the frame set can be rotated and folded to a storage configuration;

wherein the frame set comprises a first post and a second post, the control assembly further comprises a linkage bar and a second bolt, wherein a portion of the second bolt is arranged within the base and a remaining portion of the second bolt is arranged within the second post, and when the knob pushes the first bolt, the first bolt pushes the linkage bar and the linkage bar pushes the second bolt out of the base, so that the frame set can be rotated to the storage configuration.

2. The foldable treadmill as set forth in claim 1, wherein the folding mechanism further comprises a stop assembly fixed with the frame set, and when the frame set is rotated to the storage configuration, the remaining portion of the first bolt is changed to be placed within the stop assembly and thus the frame set cannot be rotated.

3. The foldable treadmill as set forth in claim 2, wherein the stop assembly comprises a sheet, a first hollow cylinder arranged at the sheet and passing through the frame set, and a second hollow cylinder arranged at the sheet, and when the frame set is rotated to the storage configuration, the remaining portion of the first bolt is bounded into the second hollow cylinder.

4. The foldable treadmill as set forth in claim 1, wherein the knob comprises a trench and a plug capable of moving within the trench, and when the knob is rotated to move the plug from a first end to a second end of the trench, the first bolt is moved out of the frame set.

5. The foldable treadmill as set forth in claim 4, wherein the control assembly further comprises a first spring providing a force to push the plug back to the first end of the trench.

6. The foldable treadmill as set forth in claim 5, wherein the control assembly further comprises a second spring arranged between the base and the first bolt, and the second spring provides a force to push the first bolt out of the base.

7. A foldable treadmill, comprising:

a base on which a user walks or runs in place;

a frame set having a first post and a second post with a lower portion pivotally connected with the base; and a folding mechanism including:

a first control assembly comprising:

a first bolt arranged at a side of the first post, wherein a portion of the first bolt is initially arranged within the base, and a remaining portion of the first bolt is initially arranged within the first post when the foldable treadmill in an operable configuration;

a first knob being contacted with the first bolt;

a second control assembly comprising:

a second bolt arranged at a side of the second post, wherein a portion of the second bolt is initially arranged within the base, and a remaining portion of the second bolt is initially arranged within the second post when the foldable treadmill in an operable configuration;

a linkage bar being arranged within the base and being contacted with the first bolt and the second bolt;

a second knob being contacted with the second bolt;

wherein the first knob is rotatable to push the remaining portion of the first bolt into the base, resulting in the remaining portion of the first bolt being pushed into the base and the portion of the second bolt being pushed into the second post via the linkage bar, so that the frame set can be rotated and folded to a storage configuration.

8. The foldable treadmill as set forth in claim 7, wherein the folding mechanism further comprises a stop assembly fixed with the first post, and when the frame set is rotated to the storage configuration, the remaining portion of the first bolt is changed to be placed within the stop assembly and thus the frame set cannot be rotated.

9. The foldable treadmill as set forth in claim 7, wherein the first knob comprises a trench and a plug capable of moving within the trench, and when the first knob is rotated to move the plug from a first end to a second end of the trench, the remaining portion of the first bolt is moved to the base, and the portion of the second bolt is moved to the second post.

* * * * *